United States Patent [19]

Whitwam

[11] Patent Number: 4,519,651

[45] Date of Patent: May 28, 1985

[54] CONVERTIBLE INNER SHELL FOR SEATING AND THE LIKE

[75] Inventor: Ronald L. Whitwam, Caledonia, Mich.

[73] Assignee: Steelcase, Inc., Grand Rapids, Mich.

[21] Appl. No.: 434,239

[22] Filed: Oct. 14, 1982

[51] Int. Cl.[3] ..... A47C 7/02

[52] U.S. Cl. ..... 297/455; 297/416; 297/421; 297/DIG. 2

[58] Field of Search ..... 297/455, 452, 454, 445, 297/416, 421, 219, DIG. 1, DIG. 2; 220/339; 428/192

[56] References Cited

U.S. PATENT DOCUMENTS

| | | | |
|---|---|---|---|
| 1,230,301 | 6/1917 | Johnson . | |
| 2,853,125 | 9/1958 | Starke . | |
| 3,013,839 | 12/1961 | Van Syoc, Sr. . | |
| 3,614,156 | 7/1969 | Sarvas . | |
| 3,669,499 | 6/1972 | Semplonius et al. . | |
| 3,872,996 | 3/1975 | Dogliotti | 220/339 |
| 4,018,479 | 4/1977 | Ball . | |
| 4,073,539 | 2/1979 | Caruso . | |
| 4,144,985 | 3/1979 | Kinslow | 220/339 |
| 4,163,496 | 8/1979 | Dogliotti | 220/339 |
| 4,289,234 | 9/1981 | Rutschke | 220/339 |

OTHER PUBLICATIONS

Steelcase-Strafor, '451 Shells, Inner and Outer.

*Primary Examiner*—William E. Lyddane
*Assistant Examiner*—Mark W. Binder
*Attorney, Agent, or Firm*—Price, Heneveld, Huizenga and Cooper

[57] ABSTRACT

A convertible inner shell is provided for constructing both armed seats and armless seats. The inner shell has a peripheral edge with at least one notch in which an end portion of a seat arm is received. A tab is hingedly connected with the inner shell, and is shaped to close the outer side of the notch when the tab is closed, so that the peripheral edge of the inner shell is substantially continuous for constructing armless seats. When the tab is opened, the notch forms a pocket in which the arm end is received, thereby adapting the inner shell to construct armed seats.

32 Claims, 14 Drawing Figures

CONVERTIBLE INNER SHELL FOR SEATING AND THE LIKE

BACKGROUND OF THE INVENTION

The present invention relates to seating and the like, and in particular to a convertible inner shell for constructing both armed seats and armless seats.

Commercial seating, such as that used in offices, transportation terminals, lounges, industry and the like is typically offered in both armed and armless versions to accommodate a wide variety of different applications. When the seating has a two-part shell construction, such as that disclosed in U.S. Pat. No. 3,669,499, two different inner shell members are usually required to construct the armed and armless versions of the seat. In the armed seat, the inner shell contains notches in its peripheral edge through which the ends of the seat arms extend. In the armless seat, the inner shell has a substantially continuous, or uninterrupted peripheral edge, so that the cushions mate with the inner surface of the outer shell.

In view of the above, it would clearly be advantageous to have a single inner shell construction, which is capable of being used to make both the armed and the armless versions of the seat. This would reduce parts inventory, handling costs, manufacturing and tooling costs, assembly line space requirements, as well as other similar factors which add to the overall construction cost of the seating. Also, it would be beneficial to provide such an inner shell which could be easily and quickly converted from one version to the other.

Another problem experienced heretofore with seating inner shells, is that when an armed inner shell is upholstered, the pockets that are formed in the edges of the cushions do not mate closely with the seat arm, thereby forming rather unsightly gaps between the cushions and arms. Further, it is extremely difficult to obtain a uniform pocket size from one cushion to the next. As a result of these two factors, it has been nearly impossible to consistently maintain clean, tight-fitting upholstery lines around the ends of the seat arm. Although special padding and custom fitting can be used to alleviate these gaps and voids, this is a very time consuming and expensive remedy, which is not practical for mass production manufacturing operations.

Although the Steelcase-Strafor '451 shell includes a knockout plug which adapts the inner shell for both armed and armless chairs, it does not alleviate the problem of consistently forming a pocket in the cushion that fits tightly with the seat arm. Furthermore, the removal of the plugs from the inner shell requires the use of a tool, is a rather tedious and time consuming task, and the tab stubs tend to hamper the formation of consistently tight arm pockets.

SUMMARY OF THE INVENTION

One aspect of the present invention is a convertible inner shell for constructing both armed and armless seats, comprising a shell body having a peripheral edge with at least one notch therein shaped to form a pocket in which a portion of a seat arm is received. A tab is hingedly connected with the inner shell, and is shaped to close the outer side of the notch when it is closed, so that the peripheral edge of the inner shell is substantially continuous for constructing armless seats. When the tab is opened, the inner shell is adapted to construct armed seats.

The principal objects of the present invention are to provide a seat inner shell which can be quickly and easily converted without the use of tools to manufacture both armed and armless seats. The convertible inner shell construction reduces overall manufacturing costs, and provides a uniform pocket size, which closely receives the arm therein to present an extremely neat, tidy appearance.

These and other features, advantages and objects of the present invention will be further understood and appreciated by those skilled in the art by reference to the following written specification, claims and appended drawings.

DETAILED DESCRIPTION OF THE PREFERRED EMBODIMENTS

Figure 1:
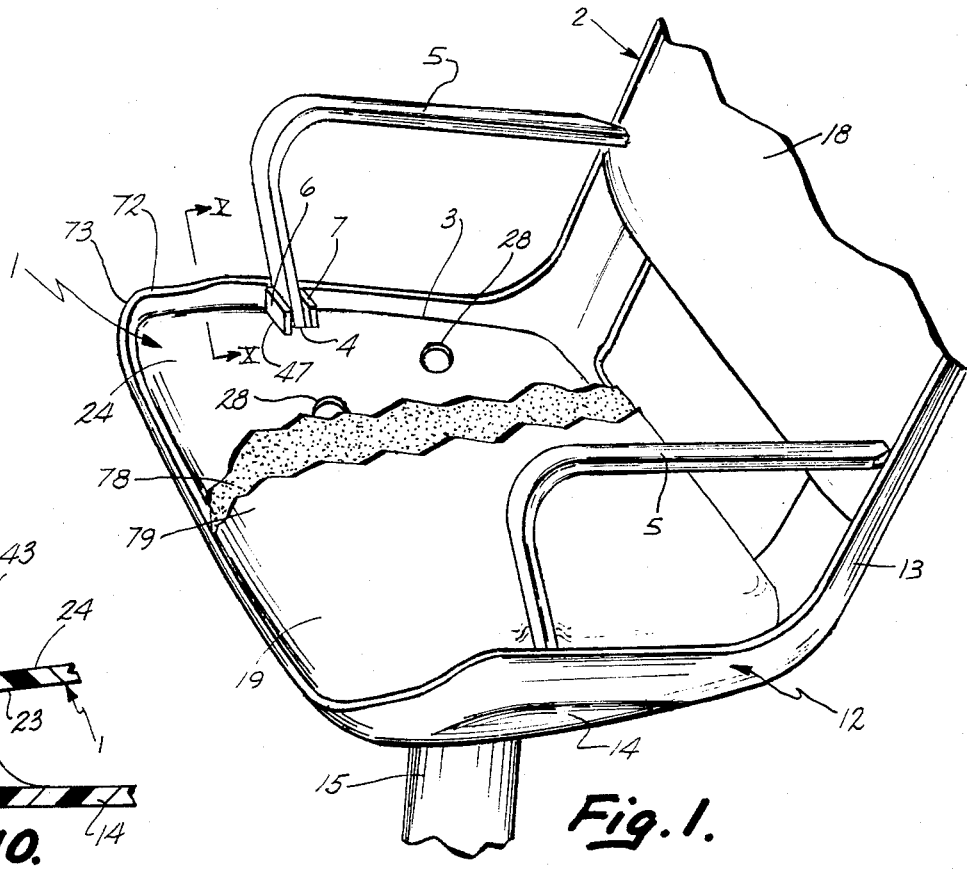
FIG. 1 is a perspective view of a seat, with portions thereof broken away to reveal a section of a convertible inner shell embodying the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary.

Figure 11:
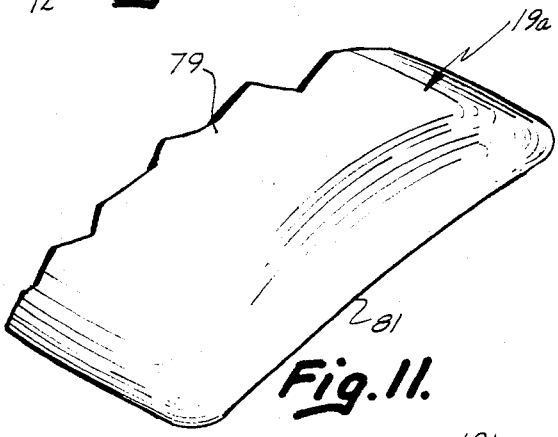
FIG. 11 is a fragmentary, perspective view of a cushion, having the inner shell therein with the tabs closed for constructing armless chairs.
Figure 12:
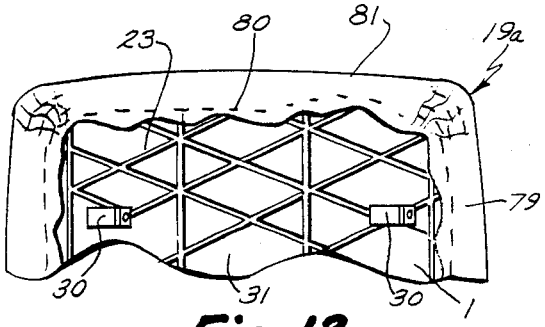
FIG. 12 is a fragmentary, bottom plan view of the armless seat cushion illustrated in FIG. 11.
Figure 13:
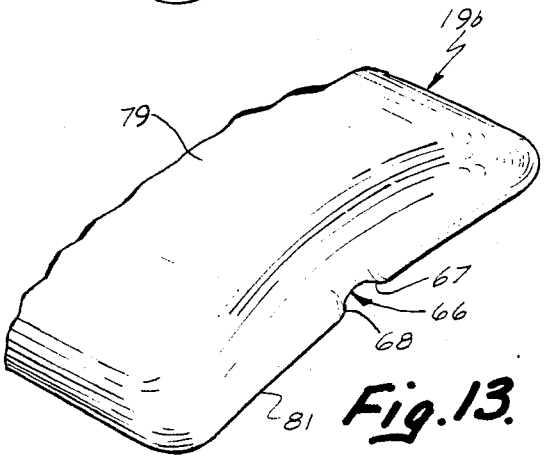
FIG. 13 is a fragmentary, perspective view of a cushion having the inner shell therein with the tabs open for constructing armed chairs.

The reference numeral 1 (FIG. 1) generally designates a convertible inner shell for constructing a seat 2 with both armed and armless versions. Inner shell 1 has a peripheral edge 3 with at least one aperture or notch 4 in which an end portion of a seat arm 5 is received. Wings or tabs 6 and 7 are hingedly connected with inner shell 1, and are shaped to close the outer side of notch 4 when tabs 6 and 7 are closed (FIGS. 2–4), so that the peripheral edge 3 of inner shell 1 is substantially continuous or uninterrupted for constructing armless seat cushions, as shown in FIG. 11. When tabs 6 and 7 are opened, notch 4 forms a pocket in which the end of the seat arm 5 is received for constructing armed seat cushions, as shown in FIG. 13.

Aside from the novel design of inner shell 1, as described in greater detail hereinbelow, seat 2 has a generally conventional construction, comprising an outer shell 12, with back and seat portions 13 and 14 respectively. Outer shell 12 is supported by a vertical pedestal 15, having standard, castered feet (not shown) at the lower end of the pedestal. The illustrated seat 2 is a commercial grade chair, such as those used in offices, conference rooms, work stations, and the like. However, it is to be understood that the present invention is equally applicable to other types of seating.

In the illustrated example, seat 14 includes separate back and seat cushions 18 and 19 respectively. Both of the back and seat cushions 18 nd 19 have an inner shell 1 which is upholstered to create the final cushion. Although the inner shell which is used in the back cushion 18 has a slightly different shape than the inner shell used in the seat cushion 19, the arm notch and closure tab concept of the present invention is equally applicable to both types of inner shells. In other words, the notch and tab arrangement for the seat cushion 19 is disposed adjacent the forward edge of seat 2, and is adapted to receive the lower end of seat arm 5 therethrough. The notch and closure tab arrangement in the back cushion 18 is disposed adjacent the lower edge of the cushion, and is adapted to receive the upper end of chair arm 5 therethrough. Since the notch and closure tab concept is conceptually identical for both the back cushion 18 and seat cushion 19, to facilitate description herein, reference will be made to only the inner shell 1 of seat cushion 19. However, it is to be understood that this same type of novel inner shell construction can also be used in conjunction with back cushion 18, as well as other similar applications.

The present invention is particularly adapted for a specific type of seat constructions, such as the illustrated seat 2, wherein the inner shell 1 is designed to fit within outer shell 12, and the cushions 18 and 19 have pillow-like rolled edges, which cover the joint or interface between the inner and outer shells. This type of cushion is quite difficult to fit properly around the seat arms 5. The cushion fitting problems experienced heretofore have also been exacerbated by the use of somewhat thicker seat arms, as the synthetic, molded arms 5 shown in FIG. 1.

The inner shell 1 (FIGS. 1 and 10) of seat cushion 19 is a substantially rigid, planar structure that is curved anatomically to conform to the shape of the seated user. Inner shell 1 comprises a lower surface 23, an upper surface 24, and a downwardly extending, vertically oriented lip or sidewall 25. The intersection of upper surface 24 and sidewall 25 defines the peripheral edge 3 of inner shell 1. A plurality of apertures 28 extend through the upper surface 24 of inner shell 1 to permit air to exhaust from and enter into the upholstered seat cushion 19, as the user sits and rises, respectively. The lower surface 29 of inner shell 1 includes means such as bosses 30, or the like, to fixedly fasten inner shell 1 to outer shell 12. Reinforcing ribs 31 extend along the lower surface 23 of inner shell 1 in a crisscrossed pattern to provide additional rigidity to the inner shell. In this example, the entire inner shell 1 is one piece, and is integrally molded from a semi-rigid, resilient, synthetic resin material, such as polypropylene.

Figure 5:
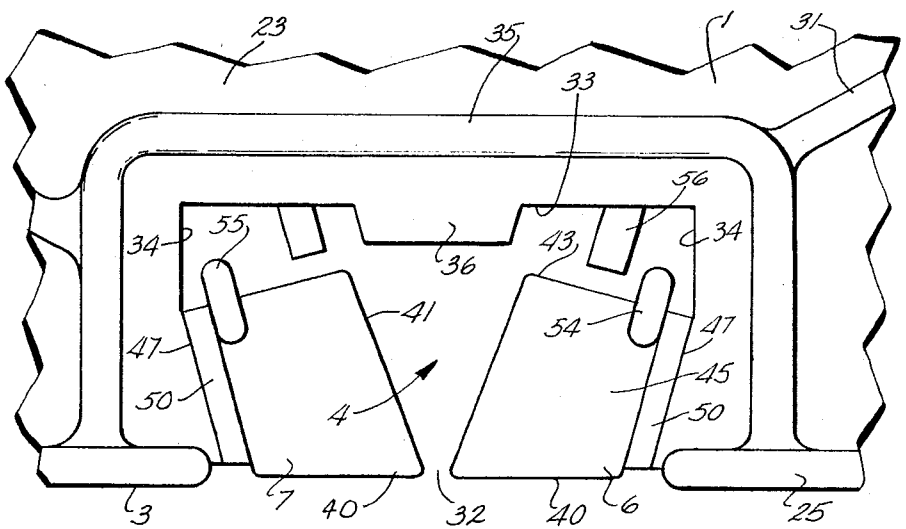
FIG. 5 is a fragmentary, bottom plan view of the inner shell, with the tabs shown in the closed position.

The inner shell 1 (FIGS. 1 and 10) of seat cushion 19 includes two notches 4, which are positioned in the left and righ-hand side edges of the inner shell adjacent the forward edge of seat 2. Notches 4 extend all the way through the peripheral edge 3 of the inner shell, and are shaped to closely receive the lower end or armature of the seat arm 5 therein. With reference to FIGS. 2–5, notches 4 have a generally rectangular plan configuration, with an open outer side 32 adjacent peripheral edge 3. Notches 4 are defined by a rear edge 33, and opposite side edges 34. As best illustrated in FIG. 5, an inverted U-shaped reinforcing rib 35 extends around notch 4, and is preferably integrally molded with the lower surface of shell upper surface 24, and shell lip 25, and reinforcing ribs 31. A trapezoidal projection 36 extends inwardly from the rear edge 33 of notch 4, adjacent the medial portion of the notch to provide support for the cushioning layer of the seat, as described in greater detail below.

Tabs 6 and 7 have a generally quadrilateral top plan configuration (FIGS. 2–5), and include an outer edge 40 that is substantially coextensive and planar with the peripheral edge 3 of inner shell 1 adjacent notch 4, when tabs 6 and 7 assume the closed position. The end or free edges 41 of tabs 6 and 7 are disposed at an acute angle with respect to outer edge 40, and intersect therewith to define rounded outer tips 42. The interior edges 43 of tabs 6 and 7 are oriented generally perpendicular with free edges 41, and are disposed adjacent to the rear edge 33 of notch 4. Tabs 6 and 7 have substantially planar upper and lower surfaces 44 and 45 that are generally parallel, but taper slightly toward their outer edges 40.

Preferably, tabs 6 and 7 are integrally molded with inner shell 1 along flexible, living hinges 47. U-shaped channels 50 extend along the lower surface 23 of inner shell 1, coextensve with living hinges 47, and reduce the thickness of the material along the bending line of the hinge, thereby facilitating the pivotal movement of tabs 6 and 7 between the open and closed positions. Hinge channels 50 are disposed at a non-perpendicular orientation with peripheral edge 3, and in this example, are at an acute angle, in the range of 70–80 degrees, with peripheral edge 3 for purposes to be described in detail hereinafter. The inwardmost sides of hinge channels 50 are coextensive with the associated notch side edges 34, such that tabs 6 and 7 can pivot freely through notch 4.

Figure 2:
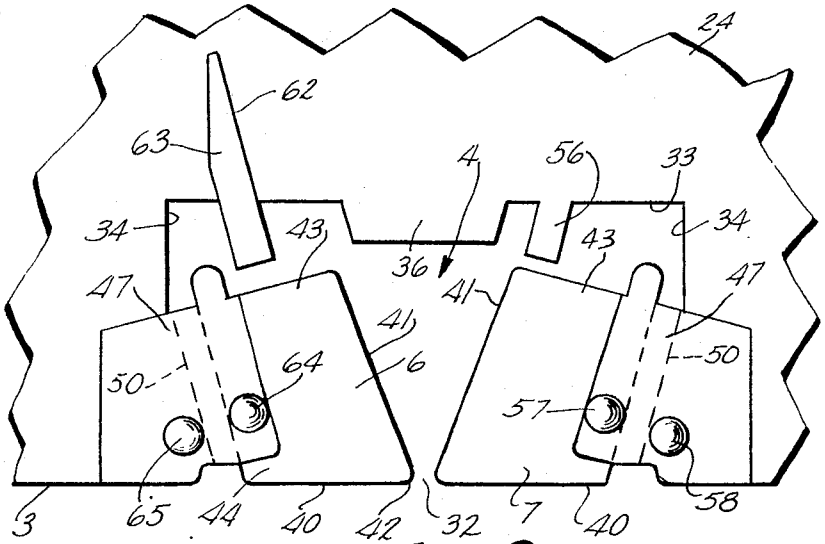
FIG. 2 is a fragmentary, top plan view of the inner shell, particularly showing a notch, with a pair of tabs illustrated in a closed position.
Figure 3:
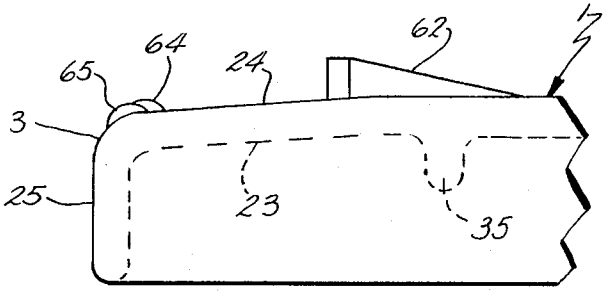
FIG. 3 is a fragmentary, end elevational view of the inner shell, with the tabs shown in the closed position.
Figure 4:
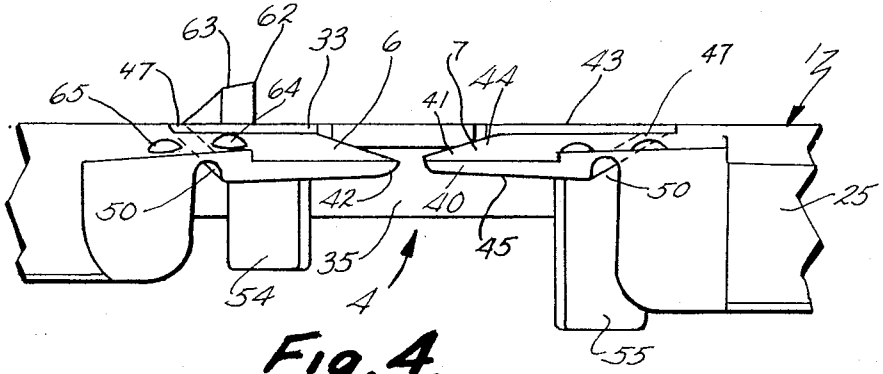
FIG. 4 is a fragmentary, side elevational view of the inner shell, with the tabs shown in the closed position.
Figure 9:
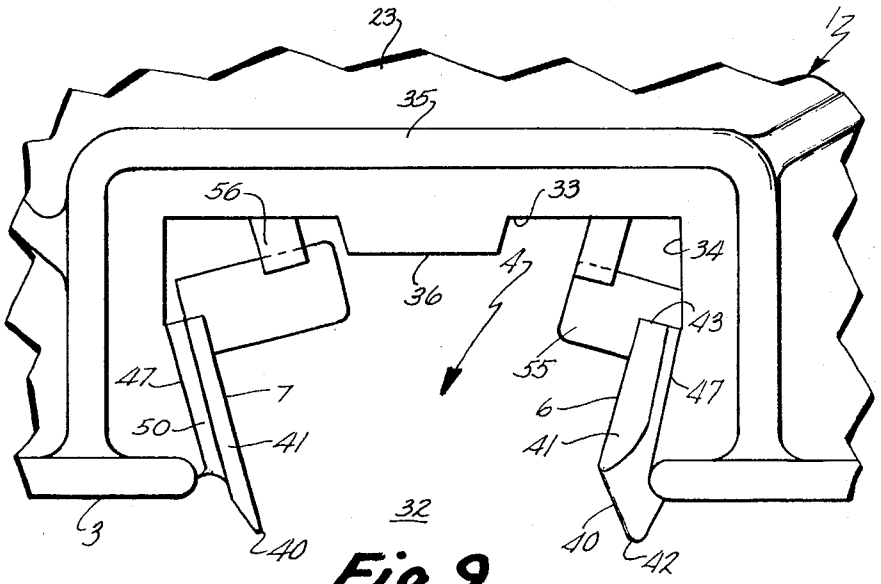
FIG. 9 is a fragmentary, bottom plan view of the inner shell, with the tabs shown in the open position.

As best illustrated in FIG. 4, tabs 6 and 7 are molded with inner shell 1 in a preselected orientation so that the tabs normally assume the fully closed position shown in FIGS. 2–4. In the fully closed position, the outer tips 42 of tabs 6 and 7 are very close together, whereby the peripheral edge 3 of inner shell 1 is substantially continuous or uninterrupted.

Figure 7:
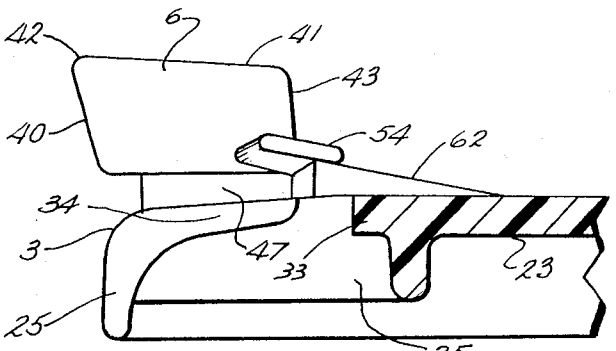
FIG. 7 is a fragmentary, cross-sectional view of the inner shell, taken along the line VII—VII, of FIG. 6.
Figure 6:
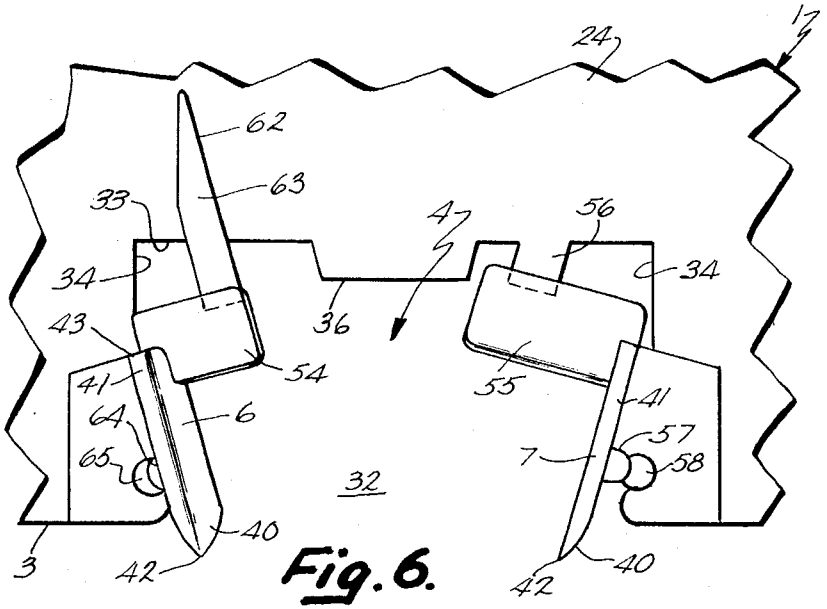
FIG. 6 is a fragmentary, top plan view of the inner shell, with the tabs shown in an open position.
Figure 8:
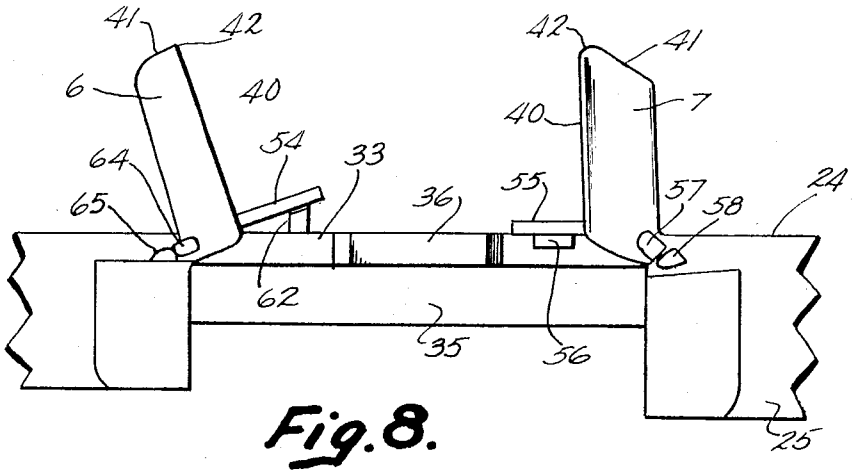
FIG. 8 is a fragmentary, side elevational view of the inner shell, with the tabs shown in the open position.

Tabs 6 and 7 both include a snap-lock arrangement, which selectively retains the tabs in the fully open position illustrated in FIGS. 6–8. Tabs 6 and 7 include semi-rigid, resilient arms 54 and 55, which are integrally molded with the associated tab, and depend therefrom adjacent the interior tab edges 43. Snap-lock arms 54 and 55 are oriented substantially perpendicular with the planar, lower surface 45 of the associated tab. In this example, snap-lock arms 54 and 55 have a substantially rectangular plan configuration.

A first stop arm 56 projects inwardly from the rear edge 33 of notch 4, and is integrally molded therewith to form a semi-rigid, resilient structure. When tab 7 is closed, snap-lock arm 55 extends downwardly from the lower surface of inner shell 1, as illustrated in FIG. 4. As tab 7 is rotated upwardly into the open position, snap-lock arm 55 abuts the lower surface of stop arm 56, and with continued rotation of tab 7, the snap-lock arm 55 snaps over stop arm 56, and comes to rest upon the upper surface thereof, as illustrated in FIG. 6, thereby positively retaining tab 7 in the fully open or raised position. A pair of hemispherical knobs or stops 57 and 58 are positioned on the upper surface 44 of tab 7, and inner shell 1, adjacent the opposite sides of hinge 47. When tab 7 is raised to the fully open position, stops 57 and 58 abut to prevent further rotation, thereby positively locating tab 7.

A second stop arm 62 projects inwardly from the rear edge 33 of notch 4 adjacent tab 6, and selectively engages snap-lock arm 54 to positively lock tab 6 in the fully upright position. The upper surface 63 of stop arm 62 is inclined downwardly toward the forward edge of seat 2 at an angle in the range of 20–30 degrees to mate with an associated portion of the seat arm 5. In a manner similar to the movement of tab 7 described above, when tab 6 is fully closed, resilient arm 54 extends generally vertically downwardly from inner shell 1, as illustrated in FIG. 4. As tab 6 is pivoted upwardly, resilient arm 54 engages the lower surface of stop arm 62. Continued rotation of tab 6 causes resilient arm 54 to snap onto the inclined, upper surface 63 of stop arm 62, thereby positively retaining tab 6 in the fully open position. Hemispherical knobs 64 and 65 abut when tab 6 is fully open to positively locate the tab.

In addition to hemispherical knobs 57–58 and 64–65, two additional pairs of stops (not shown) may be provided on the lower surface 23 of inner shell 1, on opposite sides of the living hinges 47, so that the mating stops abut when tabs 6 and 7 are fully closed to prevent further downward rotation of the tabs, and thereby assure an uninterrupted, unbroken peripheral edge 3 for armless versions of seat 2.

As best illustrated in FIG. 6, when tabs 6 and 7 are open, a pocket 66 is formed in which the lower end or armature of arm 5 is closely received. Tab 7 forms a rearward sidewall 67 of pocket 66, which is generally vertical in orientation, and is canted or inclined inwardly, with outer tip 42 pointing toward the front edge of seat 2. Tab 6 forms a forward sidewall 68 of pocket 66, which is inclined vertically toward the front edge of seat 2, and is canted inwardly with outer tip 42 pointing toward the rear of seat 2.

Figure 10:
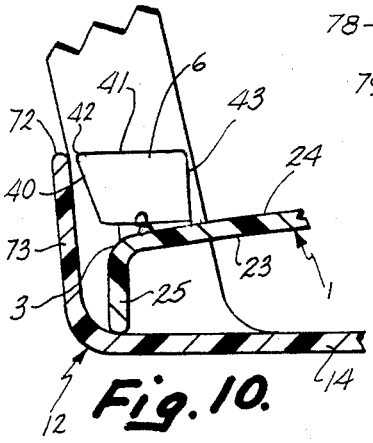
FIG. 10 is a fragmentary, cross-sectional view of the inner shell, shown installed in the seat, and taken along the line X—X of FIG. 1.

As a result of the non-perpendicular orientation of the living hinges 45 with respect to peripheral edge 3 of inner shell 1, when tabs 6 and 7 are pivoted upwardly into the open position, the outer tips 42 of tabs 6 and 7 translate laterally outwardly from peripheral edge 3. In the illustrated example, when tabs 6 and 7 are fully open, the outer tips 42 of the tabs are located approximately ⅛ inch outwardly of peripheral edge 3. As best shown in FIG. 10, when tabs 6 and 7 are fully open, the outer tab tips 42 are disposed adjacent to the upper edge 72 of a lip portion 73 of outer shell 12, and free edge 41 is substantially coplanar with edge 72. This facilitates upholstering cushions 18 and 19 in a pillow-like style with rounded edges, as described in greater detail hereinbelow.

When inner shell 1 is to be used to construct armless chair cushions 19*a* (FIG. 11), tabs 6 and 7 are left in the closed position. Inner shell 1 is then upholstered by positioning a layer of cushioning material 78 over the upper surface 24 of inner shell 1, and an outer layer 79 of textile, vinyl, etc. covering the cushion layer 78. The cover layer 79 of material is drawn tightly over the peripheral edge 3 of inner shell 1, and is attached to the lower surface 23 of the inner shell by means such as staples 80, or the like. Because the outer tips 42 of tabs 6 and 7 are positioned close together, the side edges 81 of armless cushion 19*a* are very straight, as shown in FIG. 11, so as to mate closely with the adjacent edge 72 of the outer shell 12.

Figure 14:
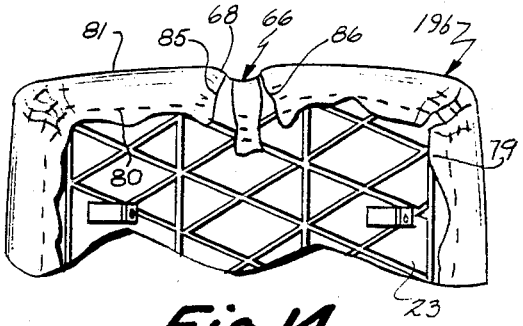
FIG. 14 is a fragmentary, bottom plan view of the armed seat cushion illustrated in FIG. 13.

When inner shell 1 is to be used to construct armed seat cushions 19*b* (FIG. 13), tabs 6 and 7 are pivoted upwardly into the fully open position, and snapped firmly into place. Rotation of tabs 6 and 7 is achieved manually, such that no tools are required to convert the inner shell 1 for armed chair applications. Inner shell 1 is then upholstered, by positioning cushion layer 78 over the upper surface 24 of the inner shell, and pulling the exterior cover layer 79 around the peripheral edge 3 of the inner shell. The outer edge of cover 79 is stapled to the lower surface 23 of the shell, as shown in FIG. 14. At the arm pocket 66, the outer edge of the cover layer 79 is split along edges 85 and 86 to form a strip 87 disposed at the center portion of the pocket. The pocket edges 85 and 86 are pulled inwardly and toward the forward and rearward edges respectively of the seat, and then stapled in place. Strip 87 is pulled inwardly between tabs 6 and 7 until tight, and then stapled to inner shell 1. As a result of this construction, the side edges 81 of armed cushions 19*b* have pockets 66 formed therein which are shaped to fit tightly about the ends of seat arm 5. The outer tips 42 of tabs 6 and 7 provide raised or extended support points which support the cushioning material 78 at predetermined locations about the armature. This extra support allows the upholstery to maintain contact with the associated outer surface of the armature, and alleviate gaps or voids between the same.

Tabs 6 and 7 facilitate consistently forming arm pockets 66 of uniform size and shape that fit very closely with the armature of the seat arm 5, thereby avoiding unsightly gaps. The convertible inner shell 1 can be quickly and easily converted without tools to make either armed or armless chairs, and serves to reduce the overall manufacturing cost of the seat.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A convertible inner shell for constructing both armed seats and armless seats, comprising:

a shell body having a perpheral edge with at least one notch therein shaped to form a pocket in which a portion of a seat arm is received, said notch having an open side at the peripheral edge of said shell body;

a tab hingedly connected with said shell body adjacent said notch, and being pivotal between open and closed positions; said tab being shaped to substantially close the outer side of said notch in the closed position, whereby said peripheral edge extends generally continuously and uninterrupted about said shell body for constructing armless seats, and said tab opens the outer side of said notch in the open position for constructing armed seats; said tab pivoting vertically into the open position, and forming a generally vertically oriented sidewall for said pocket, and including an outer tip with means for extending said tab outer tip outwardly of the peripheral edge of said shell body when said tab is pivoted into the open position to facilitate constructing a cushion which mates closely with the seat arm.

2. An inner seat shell as set forth in claim 1, wherein: said tab is molded integrally with said shell body along a flexible living hinge.

3. An inner seat shell as set forth in claim 2, wherein: said living hinge has a longitudinal axis about which said tab pivots, which axis is positioned at an acute angle with respect to that portion of said peripheral edge disposed adjacent to said notch for achieving lateral translation of said tab tip.

4. An inner seat shell as set forth in claim 3, wherein: said shell body and said tab are constructed of a semi-rigid, resilient material.

5. An inner seat shell as set forth in claim 4, wherein: said tab is molded integrally with said shell body in a preselected orientation so that said tab normally assumes the closed position.

6. An inner seat shell as set forth in claim 5, wherein: said tab includes a snap-lock which selectively retains said tab in the open position.

7. An inner seat shell as set forth in claim 6, wherein: said tab and said shell body include mating, aligned stops which abut in the open position to positively retain said tab in a preselected upholstery position for constructing armed seats.

8. An inner seat shell as set forth in claim 7, wherein said snap-lock includes:

a semi-rigid, resilient arm integrally molded with said tab, and extending generally laterally thereof; and a stop arm integrally molded with said shell body, and having a free end projecting into said notch, whereby as said tab is pivoted into the open position, said tab arm engages and snaps over said stop arm to positively retain said tab in the open position.

9. An inner seat shell as set forth in claim 1, wherein: said shell body and said tab are constructed of a semi-rigid, resilient material.

10. An inner seat shell as set forth in claim 1, wherein: said tab is molded integrally with said shell body in a preselected orientation so that said tab normally assumes the closed position.

11. An inner seat shell as set forth in claim 1, wherein: said tab includes a snap-lock which selectively retains said tab in the open position.

12. An inner seat shell as set forth in claim 11, wherein said snap-lock includes:

a semi-rigid, resilient arm integrally molded with said tab, and extending generally laterally thereof;

a stop arm integrally molded with said shell body, and having a free end projecting into said notch, whereby as said tab is pivoted into the open position, said tab arm engages and snaps over said stop arm to positively retain said tab in the open position.

13. An inner seat shell as set forth in claim 1, wherein: said tab and said shell body include mating, aligned stops which abut in the open position to positively retain said tab in a preselected upholstery position for constructing armed seats.

14. An inner seat shell as set forth in claim 13, wherein:

said tab and said shell body include a second set of aligned stops which abut in the closed position to positively retain said tab closed for constructing armless seats.

15. A convertible inner shell for constructing both armed seats and armless seats, comprising:

a shell body having a peripheral edge with at least one notch therein to form a pocket in which a portion of a seat arm is received; said notch having an open side at the peripheral edge of said shell body, and being defined by a rear edge and opposite side edges;

first and second tabs hingedly connected with said shell body adjacent the opposite side edges of said notch, and being pivotal between open and closed position; said tabs being shaped to substantially close the outer side of said notch when both of said tabs are in the closed position, whereby said peripheral edge extends generally continuously and uninterrupted about said shell body for constructing armless chairs, and said tabs open the outer side of said notch when both of said tabs are in the open position for constructing armed chairs.

16. An inner shell as set forth in claim 15, wherein: said tabs pivot upwardly into the open position, and form generally vertically oriented sidewalls for said pocket.

17. An inner shell as set forth in claim 16, wherein: said tabs include outer tips, with means for extending said outer tips laterally outwardly of the peripheral edge of said inner shell when said tabs are pivoted into the open position, to facilitate constructing a cushion which mates closely with the seat arm.

18. An inner shell as set forth in claim 17, wherein: said tabs are molded integrally with said inner chair shell along flexible living hinges.

19. An inner seat shell as set forth in claim 18, wherein:

said living hinges have axes about which said tabs pivot, which axes are positioned at an acute angle with respect to that portion of said peripheral edge disposed adjacent to said notches for achieving lateral translation of said tab tips.

20. An inner shell as set forth in claim 19, wherein: said shell body and said tabs are constructed of a semi-rigid, resilient material.

21. An inner shell as set forth in claim 20, wherein: said tabs are molded integrally with said shell body in a preselected orientation so that said tabs normally assume the closed position.

22. An inner shell as set forth in claim 21, wherein: said tabs include snap-locks which selectively retain said tabs in the open position.

23. An inner shell as set forth in claim 22, wherein: said tabs and said shell body include mating pairs of aligned stops which abut in the open position to positively retain said tabs in a preselected, upholstery position for constructing armed seats.

24. An inner shell as set forth in claim 23, wherein said snap-locks include:

semi-rigid resilient arms integrally molded with said tabs, and extending generally laterally thereof;

first and second stop arms integrally molded with said shell body, and having free ends projecting into said notch, whereby as said tabs are pivoted into the open position, said tab arms engage and snap over an associated one of said stop arms to positively retain said tabs in the open position.

25. In a seat, the improvement of a convertible inner shell for constructing both armed seats and armless seats, comprising:

a shell body adapted to be upholstered to form a cushion, and having a peripheral edge with at least one notch therein shaped to form a pocket in which a portion of a seat arm is received; said notch having an open side at the peripheral edge of said shell body, and being defined by a rear edge and opposite side edges;

first and second tabs hingedly connected with said shell body adjacent the opposite side edges of said notch, and being pivotal between open and closed positions; said tabs being shaped to substantially close the outer side of said notch when both of said tabs are in the closed position, whereby said peripheral edge extends generally continuously and uninterrupted about said shell body for constructing armless seats, and said tabs open the outer side of said notch in the open position for constructing armed seats.

26. An inner shell as set forth in claim 25, wherein:

said tabs include outer tips, and said tabs have axes about which they pivot between the open and closed positions, said axes being positioned at an acute angle with respect to that portion of said peripheral edge disposed adjacent to said notches, whereby pivoting said tabs toward the open position translates said tab outer tips laterally outwardly to facilitate constructing a cushion which mates closely with the seat arm.

27. An inner shell as set forth in claim 26, wherein:

said seat includes an outer shell with an upturned lip which is shaped to receive said inner shell therein; and said tabs have outer edges, which are disposed at an elevation substantially coextensive with an uppermost edge of said outer shell lip when said tabs are in the open position.

28. An inner shell as set forth in claim 27, wherein:

said tab tips are positioned closely adjacent to the upper edge of said outer shell lip when said tabs are in the open position.

29. An inner shell as set forth in claim 28, wherein:

said tabs pivot upwardly into the open position, and form generally vertically oriented sidewalls for said pocket.

30. An inner shell as set forth in claim 29, wherein:

said tabs are molded integrally with said inner chair shell along flexible living hinges.

31. An inner shell as set forth in claim 30, wherein:

said tabs include snap-locks which selectively retain said tabs in the open position.

32. An inner shell as set forth in claim 31, wherein:

said tabs and said shell body include mating pairs of aligned stops which abut in the open position to positively retain said tabs in a preselected, upholstery position for constructing armed seats.

* * * * *

UNITED STATES PATENT AND TRADEMARK OFFICE

CERTIFICATE OF CORRECTION

PATENT NO. : 4,519,651

DATED : May 28, 1985

INVENTOR(S) : Ronald L. Whitwam

It is certified that error appears in the above-identified patent and that said Letters Patent is hereby corrected as shown below:

Column 3, line 20:
"18 nd 19" should be -- 18 and 19--;

Column 4, line 5:
"righ-hand" should be --right-hand--;

Column 4, line 39:
"coextensve" should be --coextensive--;

Column 6, line 58, Claim 1:
"perpheral" should be --peripheral--.

Signed and Sealed this

*Fourth* Day of *February 1986*

[SEAL]

*Attest:*

DONALD J. QUIGG

*Attesting Officer*

*Commissioner of Patents and Trademarks*